United States Patent [19]

Varotto et al.

[11] 3,960,548

[45] June 1, 1976

[54] PROCESS FOR THE SEPARATION OF COMPONENTS IN MULTICOMPONENT MIXTURES, FOR THE CASE WHEREIN THE DIAGRAM OF BINARY PHASES OF THE TWO MAJOR COMPONENTS PRESENTS A MONOTECTIC AND THEIR DENSITIES ARE DIFFERENT

[75] Inventors: Conrado F. Varotto; Miguel Angel Audero; Daniel I. Vasallo; Roberto Pascual; Hector J. Ruffo, all of San Carlos de Bariloche, Argentina

[73] Assignees: Comision Nacional de Energia Atomica; Compania Metalurgica Austral Argentina, both of Buenos Aires, Argentina

[22] Filed: Mar. 25, 1974

[21] Appl. No.: 454,696

[30] Foreign Application Priority Data

Mar. 27, 1973 Argentina ..... 247269

[52] U.S. Cl. ..... 75/78; 75/63; 75/88

[51] Int. Cl.[2] ..... C22B 13/06

[58] Field of Search ..... 75/14, 44 S, 63, 65, 75/78, 86, 88

[56] References Cited

UNITED STATES PATENTS 2,464,262 3/1949 Robson ..... 75/86

*Primary Examiner*—M. J. Andrews

*Attorney, Agent, or Firm*—Kenyon & Kenyon

[57] ABSTRACT

A process for the separation of components in multicomponent mixtures, for the case wherein the diagram of binary phases of the two major components presents a monotectic and their densities are different, consisting of successive coolings and heatings of the material to be purified between temperatures above and below the monotectic reaction temperature and/or the solid/liquid transformation temperature, having as a final result the separation of the components in the desired degree, up to the limits the system will allow for reasons intrinsic thereto.

7 Claims, 6 Drawing Figures

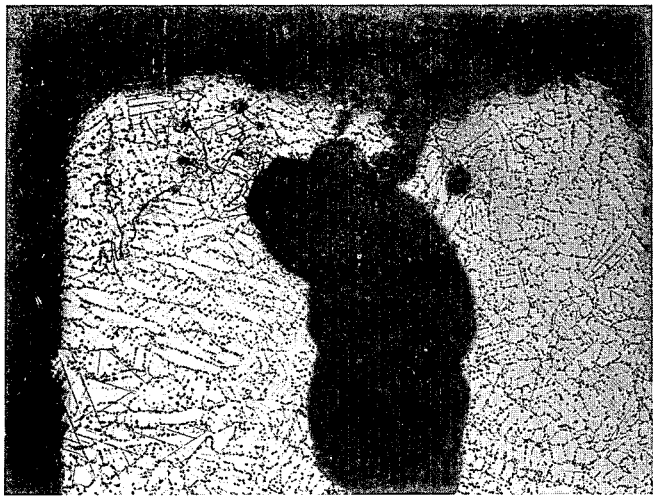
FIG. 4 A
FIG. 4 B
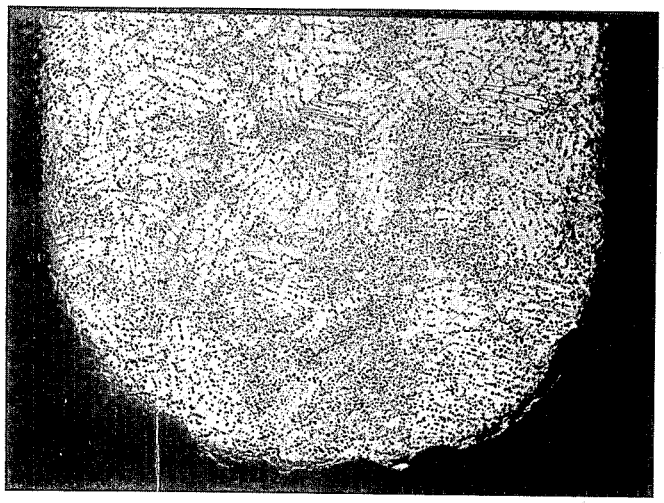
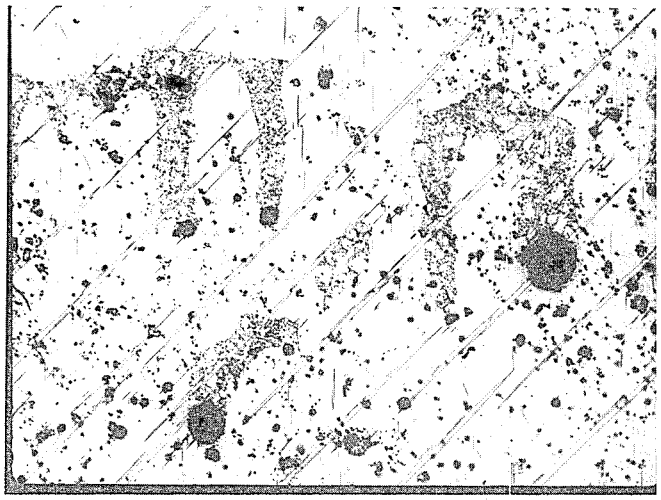
FIG. 5

PROCESS FOR THE SEPARATION OF COMPONENTS IN MULTICOMPONENT MIXTURES, FOR THE CASE WHEREIN THE DIAGRAM OF BINARY PHASES OF THE TWO MAJOR COMPONENTS PRESENTS A MONOTECTIC AND THEIR DENSITIES ARE DIFFERENT

BACKGROUND OF THE INVENTION

1. FIELD OF THE INVENTION

The present invention relates to an industrial method for separation of the two major components in a multicomponent mixture, when said two components have in the binary system a monotectic reaction and there are differences between their densities.

The described method will be shown for the case of Zn/Pb major component mixtures, but its scope is generic.

2. DESCRIPTION OF THE PRIOR ART

Industrial methods for extraction of metals from their ores yield final products the purity whereof varies according to the process employed and the characteristics of the starting ore. A typical case is that of the difference there is between the purity of Zn obtained by an electrolytic process as compared with the electrothermic process. In this last case the typical and major impurity usually is Pb, depending on the starting ore.

An industrially used process for reducing the Pb content in electrothermic Zn is the one described in German Pat. DBP No. 1,142,704 and explained in detail in the literature, but it requires addition of Na as a third element, which is not totally eliminated, as there remains a residual concentration of 0.03% in Zn.

The most frequently used industrial method for purification of electrothermic Zn (removal of lead) is to resort to the properties indicated in the liquid-vapor system diagram of phases (distillation); by means of this process Zn of a purity comparable to the electrolytic product can be obtained.

The method proposed in the present invention serves to obtain an intermediate purity insofar as removal of Pb is concerned and is based on the properties of the solid/liquid equilibrium diagram, as well as on the kinetic type phenomena governing the solid/liquid transformation of the major components binary system; in this particular case, the Zn/Pb system. The advantages of the method proposed arise from the comparison of fusion and vaporization latent heats, thus implying a large reduction in the cost of the process and in the simplicity of equipment construction, operation and maintenance.

It is well known that differences in composition between phases in equilibrium in multicomponent systems cause segregation phenomena in the course of processes involving more than one phase, particularly the solid/liquid type. While in the case wherein a final product having a uniform composition is required, segregation must be avoided, the latter, conveniently promoted, may be used in separation processes. Typical examples thereof are the fractional distillation processes, widely used in chemistry, of non-metal solutions and the zonal fusion purification process. Separation can be more effective in cases in which there is a remarkable difference in density between the solid and the liquid and what is desired is simply to obtain a separation of solid-liquid of different compositions.

This separation can be intensified by means of centrifugation.

The present invention is precisely directed to a method which, based on the mechanisms governing the alloy solidification process, enable obtaining a separation of the two major components in a multicomponent alloy, up to an acceptable limit for certain industrial uses. For the method to be effective, it is necessary that said components satisfy the following conditions: (1) that they present a monotectic transformation in the binary system, and (2) that they differ in density. The method will be exemplified for the case of a multicomponent alloy having Zn and Pb as major components, with a Pb content which may be greater or lesser than in the monotectic composition.

SUMMARY OF THE INVENTION

The method of separation which is the object of the present invention is based on successive coolings and heatings of the material to be purified, between temperatures above and below the monotectic reaction temperature and/or solid/liquid transformation temperature, having as a final result separation of the components in the desired degree, up to the limits the system will allow for reasons intrinsic thereto. The method has shown to be effective both with hyper- and hypo-monotectic composition materials. Maximum and minimum temperatures, as well as the time during which the material is maintained at the monotectics temperature and/or the solid/liquid transformation temperature, may be varied within a broad range. Furthermore, the method is more effective if as physical separation of the components advances, liquid rich in one of the components is removed, Pb in the case of the Zn/Pb system, so that the tendency of the system to homogenize again for thermic reasons (diffusion, convection, etc.) is minimized.

The process (with or without removal) makes it possible to obtain substantially hypomonotectic compositions starting from both hyper- and hypo-monotectic composition material. The method can be schematically described as follows: one starts from a material the two major components of which are A and B, and having an initial composition of $X_A$ and $X_B$. Starting from an initial temperature $T_1 > T_M$ (where $T_M$ is the temperature of the monotectic or of the solid/liquid transformation), the material is cooled at a certain rate of cooling that may vary with a broad range, and is then maintained at the temperature of the monotectic and/or of the solid/liquid transformation for a variable period of time, which may or may not permit the total transformation of the material. In the event that the material is totally transformed, cooling is continued down to temperature $T_2 > T_M$, also at a variable rate and within a broad range of variation. Temperature $T_2$ can also vary in a broad range, but the process shows that it is not necessary to make it much below the temperature of the monotectic or of the solid/liquid transformation. The process is then repeated in the reverse direction, that is, the material is heated towards temperatures above $T_2$. The rate of heating may vary within a broad range and once the temperature of the monotectic and/or of the solid/liquid transformation has been reached, the material is maintained at that temperature for a variable period of time, which may or may not permit total transformation, and then, if permitted, the temperature of the material is raised at a rate which may vary within a broad range up to temperature $T_1'$, which may be higher, the same or lower than initial temperature $T_1$, and than the maximum temperatures of the successive heatings to which reference will be made hereinafter. By repeating the above process as many times as necessary and always maintaining variable or not the maximum and minimum temperatures, the heating and cooling rates, as well as the time for which the material is kept at the monotectic and/or solid/liquid transformation temperature, considerable values of purification of materials can be achieved. The process has shown to be effective both with ingots below 1 kg (at laboratory scale) as well as with industrial type ingot. The criterion for selecting a given maximum and minimum temperature, a given rate of heating and cooling, as well as a given time of residence at the monotectic and/or solid/liquid transformation temperature, in each cycle, is to favor the mechanism of separation which, in each stage of the process, is considered to be the most effective, or convenient. All this is carried out operating with the method of heat removal and supply, using known apparatus such as salt-bath furnaces, radiation furnaces and, in general, any means capable of providing the necessary amount of heat to carry out the above operations and whatever the source of energy used may be.

The method contemplates removal of the material rich in the heavier component by the lower part of the mold, either through a high temperature valve or of a port allowing metered, discontinuous or continuous, exit of the material in the liquid state during the whole separation process. Removal of the purified material from the upper part of the mold is also contemplated, in liquid state and by means of a system of elevation of said material (vacuum, suction pump, etc.), or by simply tilting the mold.

FIG. 4A is a photomicrograph of the upper part of the Zn-Pb ingot after applying the present method.

FIG. 4B is a phrtomicrograph of the lower part of a Zn-Pb ingot after applying the present method.

FIG. 5 is a photo-micrograph of a Zn-Pb specimen which was tempered in water during melting.

In the specific case of the Zn/Pb system, the final result consists in a lead-rich material in the lower part of the ingot, while the remainder is Zn of a purity higher than the starting material. This can be observed in FIGS. 4A and 4B, belonging to a specimen which was submitted to a treatment as described above.

FIG. 4A shows the upper part and FIG. 4B the lower part of said specimen. It can be clearly observed that in the upper region there is a lesser quantity of Pb-rich particles than in the lower region. It should be explained that in the periphery of the lower end cavities are noted which were occupied by the Pb-rich phase, which settled, and was torn away therefrom due to the metallographic treatment the specimen was given.

A typical example of operative values is $T_1 = 430°C.$; $T_2 = 400°C$; total time of one heating and cooling (cycle): 14 minutes, with a residence time at the temperature of the monotectic of 6 minutes, both in the heating and in the cooling; after several cycles and starting from Zn having a Pb content above 1.4% by weight, a material was obtained having a purity such that the Pb percentage was below 0.04% by weight.

Figure 1:
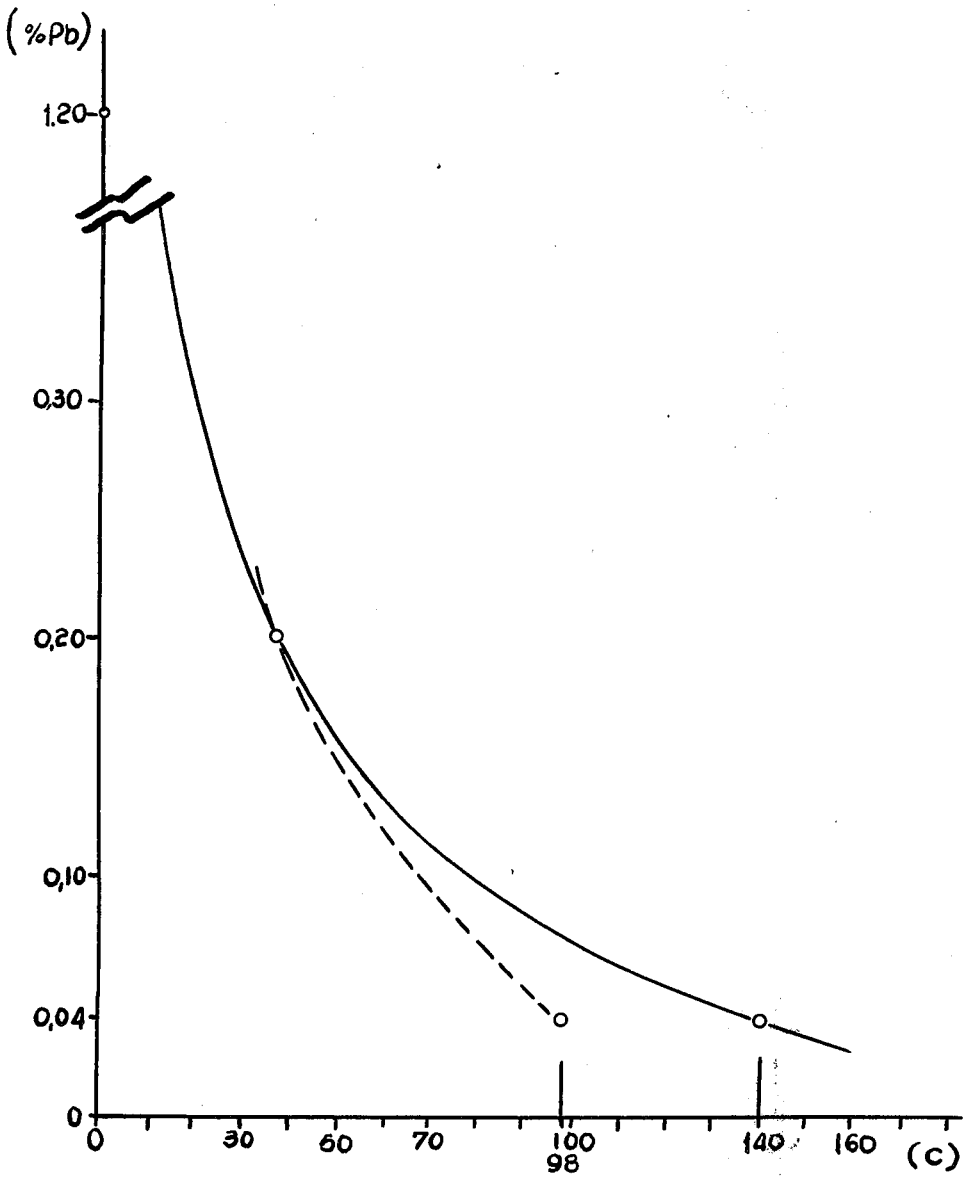
FIG. 1 is a graph which shows the Pb percentage by weight in a Pb-Zn ingot as a function of the number of cycles in the present process.

The importance of effecting removals of denser materials during the purification process is shown by the curves in FIG. 1, which represents the Pb percentage, by weight, in a zone of the ingot in question as a function of the number of cycles, for the example under consideration. The upper curve represents the case in which no material removal is made, while the lower curve represents the case wherein when the material reaches a certain concentration (0.20% Pb by weight in the case illustrated), a removal of material is made from the lower zone of the ingot (less than 10% of the ingot total), then to continue thermally cycling the material. It can be observed that the same final concentration of 0.04% Pb by weight is obtained in approximately 140 cycles in the event that no removal of material is made, while 98 cycles are needed in the case but one removal alone of material is carried out. In both cases the average initial concentration of Pb in the ingot was above 1.2% by weight (approximately 1.4%).

The importance of conducting a removal of material very rich in the denser element is observed in the final concentration obtained for a same number of final cycles. For the thermal treatment conditions we are considering, if the material is subjected to 23 cycles of heating and cooling a purity of 0.28% Pb by weight in a certain zone of the ingot is obtained. If on the other hand the same number of cycles is applied in the following way: 10 cycles, then a removal of material is effected by the lower part of the ingot, in the order of about 10% of the total ingot, then a further 13 cycles similar to the first ones is applied, a purity of 0.082% Pb by weight is obtained.

DETAILED DESCRIPTION

Different mechanisms work in the separation of the elements, described in the process of the present application. For the better understanding thereof in the diagram of FIG. 2 there is shown the diagram of equilibrium phases typical to a binary system presenting a monotectic reaction. Further, in the case of interest for this specification, the components of the binary system must differ in density. It shall be assumed that element B is denser than element A and, to the purposes of its application to system Zn/Pb, it shall be understood that element A is substituted by Zn and element B by Pb.

If a liquid mixture of a composition higher than the monotectic (for example, $C_E$ in FIG. 2) is obtained through a given extraction process, from observation of the equilibrium diagram it shall be seen that a first separation can be obtained if the liquid mixture is maintained for a period of time at temperatures such that liquids $L_1$ and $L_2$ coexist. As these two liquids differ in density, settling of the denser one occurs. This is the method used industrially to purify the Zn obtained by electrothermal processes starting from Zn rich material but having a high Ph content, a partial separation of both components being produced. By observing FIG. 2 it can be concluded that this process of separation has a limit established by the composition of the monotectic, that is, a material having a B content lower than $C_M$ cannot be obtained. Thus, in the case of the Zn/Pb system, the monotectic composition of which is 0.9% Pb by weight, Zn is obtained with a Pb content by weight within the range of 1.2 and 1.4%, a value that may be considered very good for an industrial process of said type.

As indicated earlier, the process of the present invention makes it possible to purify the basis material down to B (Pb) contents for below the monotectic composition. The mechanisms acting therein are the following:

I GRAVITY SEPARATION IN HETEROGENEOUS LIQUID PHASE

This is the mechanism indicated before for obtaining material close to the monotectic composition. Of course, it will only be effective for compositions above the monotectic and will show for all the ingot during the first cooling, being each time less efficient in successive cycles, as the portion of ingot having a concentration above the monotectic shall be less.

II GRAVITY SEPARATION IN HOMOGENEOUS LIQUID PHASE.

When the starting composition is close to the monotectic, by maintaining the material at a temperature such that it will be in a monophasic liquid state (that is, homogeneous as would be in the $L_1$ zone in FIG. 2), due to the difference in density of the substances forming the mixture, and as foreseen by thermodynamics, a concentration gradient is produced owing to the difference in density between components A and B of the liquid phase on account of the gravitational term in the chemical potential of the solution components. This mechanism renders a continuous distribution of B in A, with a not very high concentration gradient.

III SETTLING OF $L_2$ GENERATED BY MONOTECTIC TRANSFORMATION DURING SOLIDIFICATION.

Figure 2:
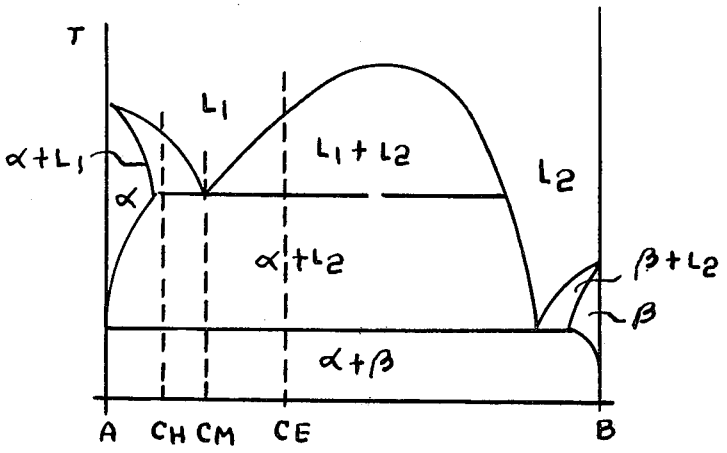
FIG. 2 is a phase diagram of a binary system presenting a monotectic reaction.

Upon solidifying the liquid having a composition close to the monotectic, during liquid-solid transformation, $\alpha$, $L_1$ and $L_2$ coexist (see FIG. 2). The liquid $L_2$, product of the monotectic reaction, can partly be trapped by the solid, but can also partly settle within $L_1$. Falling spherules of $L_2$ can be united and coalesce therebetween forming larger spherules, which will result in a more effective separation, as according to Stokes' law they will fall at a higher limit velocity.

IV FORMATION AND FALLING OF $L_2$ IN THE SOLIDIFICATION FRONT.

When the material contains an amount of element B below the one corresponding to the monotectic composition, and if $k_o < 1$, where $k_o$ is the solute partition coefficient, rejection of the solute by the solid may originate an increase in the concentration of liquid in front of the solid/liquid interphase. This increase in composition can be of such a magnitude that in that zone the liquid reaches the monotectic composition, mechanism III then acting.

In the event that the increase in concentration is not sufficient for the liquid to acquire the monotectic composition in front of the interphase, in this place there will be $L_1$ liquid richer in element B, and convective currents of constitutional origin will be originated which will carry the denser liquid towards the lower zones in the ingot.

V REFLOATING OF PHASE $\alpha$.

In the liquid/solid transformation generally the solid is denser than the liquid. But when dealing with alloys components whereof differ in density, it may happen that the solute content will increase the density of the liquid above the density of the solid, thus producing refloating of the latter. When this occurs in monotectic transformations, refloating of $\alpha$, apart from settling of $L_2$, is produced, thus increasing efficiency of the separation.

On the other hand, when the material is situated in the field $\alpha + L_2$, if phase $L_2$ is continuous refloating of $\alpha$ can occur. It should be noted that this mechanism works both in the solidification and the melting of the material, as phase $\alpha$ is the one having the higher melting temperature.

For this mechanism to work it is necessary that the solid is free in the liquid, as when nucleation thereof occurs within the liquid. When the solid nucleates on the walls of the mold, and grows inwardly in a direction opposite to the heat extraction direction, multiplying mechanisms may operate which brake up existing crystals, these thus being placed in conditions for refloating. This mechanism has in some aspects a certain relation with the one described by Allen and Isserow, where separation of U/Al type eutectics is promoted (different from the case of the present specification, which refers to monotectics). For said eutectic, however, its working is dubious as the solid phases do not nucleate, and grow independently.

VI FALLING OF SPHERULES OF $L_2$ DURING MELTING.

Figure 3:
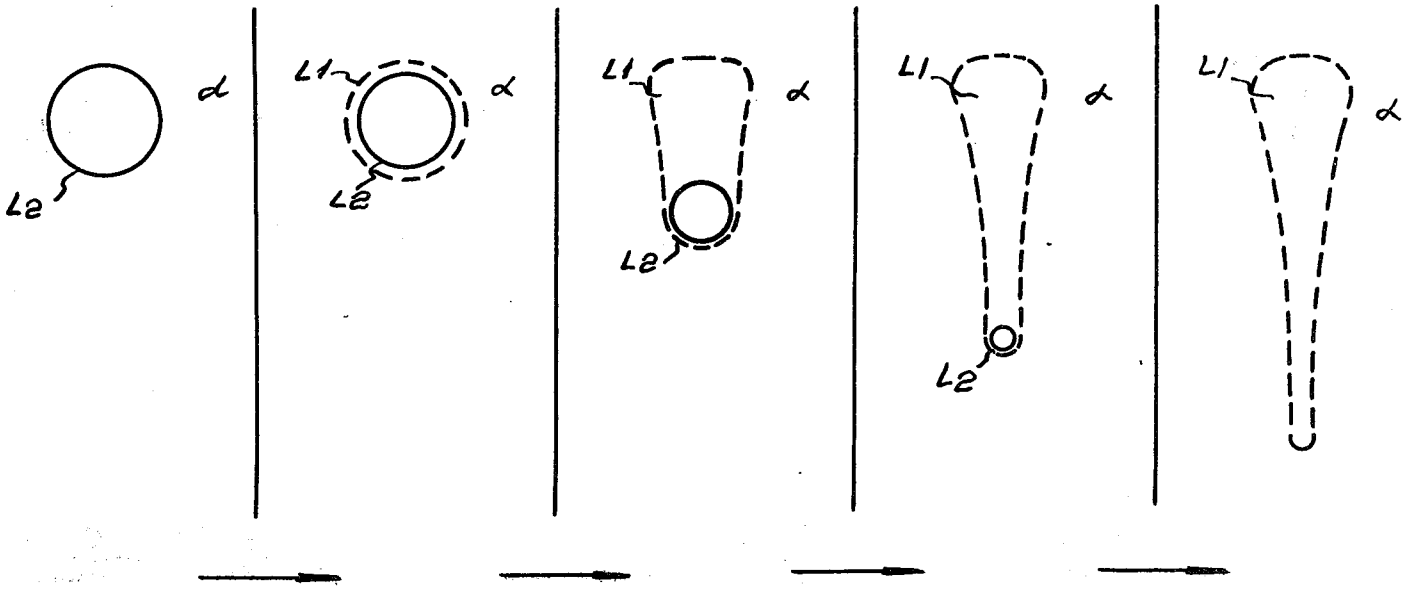
FIG. 3 illustrates the falling of spherules during melting according to the present method.

In the part of the cycle in which melting of the material is produced, the first to melt are the zones which originated in the $L_2$ spherules formed during the preceding part of the cycle and were trapped in the solid $\alpha$. Then these zones of $L_2$ liquid begin to react with the surrounding material, consisting principally in phase $\alpha$, so that zones are formed where $L_1$ and $L_2$ coexist, the falling of L being produced while it is reacting with phase $\alpha$. This is shown schematically in FIG. 3.

This mechanism works until phase $L_2$ is completely dissolved, and for this reason it will be so much more effective the larger the $L_2$ spherules are. FIG. 5 is a photomicrograph showing the working of this mechanism in a specimen of Zn/Pb which was tempered in water during the melting in the sixth cycle.

In order that the mechanisms work with a maximum efficiency, the total cycle times, maximum and minimum temperature heating and cooling rates, and proportion of transformation in the melting and solidification more suitable to the effect are selected, which may be different between one and another cycle.

What is claimed is:

1. A process for the separation of components in multicomponent mixtures, for the case where the diagram of binary phases of the two major components to be separated presents a monotectic and their densities are different, said process comprising the steps of (a) melting the mixture and heating it to a temperature above the temperature of the monotectic and/or of the solid/liquid transformation depending on the composition of the mixture; (b) cooling the mixture from the maximum temperature, controlling the rate of cooling until a temperature about that of the temperature of the monotectic transformation is reached; (c) maintaining the mixture at the temperature of the monotectic transformation for a preestablished period of time; (d) cooling the mixture down to a temperature below the temperature of the monotectic transformation the cooling being made at a controlled rate; (e) heating the material from the lower temperature reached, up to the temperature of the monotectic transformation controlling the heating rate; (f) maintaining the mixture at the temperature of the monotectic for a preestablished period of time; (g) heating the mixture up to a maximum temperature, above the temperature of the monotectic and/or of the solid/liquid transformation depending on the composition of the mixture, the heating being conducted at a controlled rate, wherein the new higher maximum temperature may be higher, the same or lower than the maximum starting temperature; and (h) separating from said mixture liquid rich in said denser component.

2. The process of claim 1, wherein the sequence of steps (a) through (g) is cyclically repeated as many times as necessary to obtain a determined degree of separation of the components.

3. The process of claim 1 further comprising removing the denser component continuously or discontinuously during the course of the process.

4. A process for separating lead from a multi-component zinc mixture comprising the steps of:

a. melting and heating the mixture to a temperature of at least 420°C;
b. cooling the mixture from the maximum temperature, while controlling the rate of cooling, until the temperature at which monotectic reaction occurs is reached;
c. maintaining the mixture at a temperature between about 417°C and 320°C for a period of time of at least 6 minutes;
d. cooling the mixture to below the temperature of the monotectic at a controlled rate;
e. heating the mixture from the lower temperature reached up to the monotectic at a controlled rate;
f. maintaining the mixture at the monotectic temperature for a pre-established period of time;
g. heating the mixture to a higher temperature from that of the monotectic and/or the solid/liquid transformation;
h. repeating the process cyclically as many times as necessary to obtain determined degree of separation of the components into a zone rich in Pb and a zone rich in Zn;

i. removing the denser component continuously or discontinuously at any time during the course of the process; and
j. separating the zone rich in Pb from said mixture.

5. A process for separating lead from a multicomponent zinc mixture, wherein Zn and Pb are the major components of said mixture, with compositions of Pb above or below the composition of the monotectic of the Zn/Pb system and assuring a physical separation of zones of material with any composition of Pb between the starting composition and compositions below 0.04% Pb in Zn and those having more than 90% Pb in Zn, said process comprising the steps of:

a. melting and heating the mixture to a temperature above the temperature of the monotectic and/or the solid/liquid transformation temperature, depending on the mixture;
b. cooling the mixture from the maximum temperature, while controlling the rate of cooling, until the temperature at which monotectic reaction occurs is reached;
c. maintaining the mixture at that temperature for a preestablished period of time;
d. cooling the mixture to below the temperature of the monotectic at a controlled rate;
e. heating the mixture from the lower temperature reached up to the monotectic at a controlled rate;
f. maintaining the mixture at the monotectic temperature for a preestablished period of time;
g. heating the mixture to a higher temperature from that of the monotectic and/or the solid/liquid transformation temperature, according to the composition of the mixture under treatment to form a zone rich in Pb and a zone rich in Zn; and
h. separating the zone rich in Pb from said mixture.

6. The process of claim 5 wherein the temperature of step (a) is at least 420°C, the period of time in steps (c) and (f) is at least 6 minutes, and the temperature of step (c) is between approximately 417°C and 320°C.

7. The process of claim 5, wherein the process is cyclically repeated as many times as necessary to obtain a determined degree of separation of components.

* * * * *